US007191693B2

(12) United States Patent
Ax et al.

(10) Patent No.: US 7,191,693 B2
(45) Date of Patent: Mar. 20, 2007

(54) ARRANGEMENT FOR WEAPON

(75) Inventors: Lars Ax, Tullinge (SE); Eje Lantz, Eskilstuna (SE); Kent Norgren, Karlskoga (SE); Rolf Pettersson, Torshälla (SE)

(73) Assignee: Saab AB, Linköping (SE)

( * ) Notice: Subject to any disclaimer, the term of this patent is extended or adjusted under 35 U.S.C. 154(b) by 164 days.

(21) Appl. No.: 10/858,471

(22) Filed: Jun. 2, 2004

(65) Prior Publication Data

US 2005/0217468 A1 Oct. 6, 2005

(30) Foreign Application Priority Data

Jun. 5, 2003 (SE) ..... 0301627-6

(51) Int. Cl.
*F41A 1/08* (2006.01)

(52) U.S. Cl. ..... 89/1.701; 89/1.703; 102/437

(58) Field of Classification Search ..... 89/1.701, 89/1.702, 1.703, 1.706; 102/437
See application file for complete search history.

(56) References Cited

U.S. PATENT DOCUMENTS 2,791,961 A 5/1957 Musser
3,614,907 A * 10/1971 Haglund et al ..... 89/1.7
4,029,017 A * 6/1977 Hubsch et al. ..... 102/202
4,902,043 A 2/1990 Zillig et al.
5,216,194 A * 6/1993 Boire ..... 89/1.706
5,900,575 A * 5/1999 Johansson et al. ..... 89/1.706
5,952,601 A * 9/1999 Sanford et al. ..... 89/1.706
6,971,299 B2 * 12/2005 Franzen et al. ..... 89/1.701

FOREIGN PATENT DOCUMENTS

DE 1012849 A 7/1957
FR 2720821 A 12/1997
GB 2129105 A 5/1984
SE 406805 * 2/1979
SE 8205956-9 B1 10/1982
SE 520975 * 9/2003

* cited by examiner

*Primary Examiner*—J. Woodrow Eldred
(74) *Attorney, Agent, or Firm*—Venable LLP; Eric J. Franklin

(57) ABSTRACT

An arrangement for a weapon including a countermass for reducing the pressure around the weapon. The countermass is enclosed in a countermass container with an openable cover provided with break indications. The arrangement brings about a symmetrical opening operation with favorable recoil in a better way than in previous constructions. This is achieved by the introduction of a guiding folding support arranged adjacent to the openable cover on the inside of the cover relative to the countermass container.

13 Claims, 2 Drawing Sheets

ARRANGEMENT FOR WEAPON

CROSS-REFERENCE TO RELATED APPLICATIONS

This application claims priority to Swedish patent application 0301627-6 filed Jun. 5, 2003.

FIELD OF THE INVENTION

The present invention relates to an arrangement for a weapon including a countermass for reducing the pressure around the weapon, the countermass being enclosed in a container arranged in the barrel of the weapon behind an ammunition part, such as a projectile or shell, and including an openable cover with break indications on the ammunition part side.

BACKGROUND OF THE INVENTION

In order to increase the backward momentum and thus make possible an increase in the weight of the ammunition part without excessively high pressure being created behind the weapon, it has been known for many years to introduce what is known as a countermass. When the countermass leaves the rear part of the barrel, it expands and disintegrates. A liquid cloud is formed, which is braked rapidly and produces a pressure-reducing effect adjacent to the weapon. In this connection, reference may be made to our SE patent 8205956-9 which shows an example of a weapon with countermass.

A critical stage in weapons with countermass is the opening phase of the countermass container. In this regard, it is important to obtain symmetrical opening of the cover of the countermass container where all break indications contribute simultaneously to the opening operation. If any part of the cover does not open at the same time as the other parts, an asymmetrical flow is created in the countermass container, which can produce great shear forces on the barrel and also great recoil variations within the temperature range. It may also happen that pieces come away from the cover. Pieces which come away from the cover constitute a great risk behind the weapon.

The opening operation of the cover also depends on the temperature of the weapon or of the countermass container, which can vary between −40° and +60°. In order for the opening operation of the cover to have as small a variation spread as possible and to create optimum opportunities for small recoil spreads, it is important to compensate for pressure variations.

For the functioning of the weapon, it is also important that the countermass has a homogeneous form when it leaves the countermass container.

SUMMARY OF THE INVENTION

The object of the present invention is to produce an arrangement for a weapon with countermass which brings about a symmetrical opening operation with favorable recoil in a better way than previous constructions.

The object of the invention is achieved by an arrangement characterized in that a guiding folding support is arranged adjacent to the openable cover on the inside of the cover relative to the countermass container. By means of the invention, a well-defined, centred opening area which minimizes the risks of disrupted gas flow into the countermass container is obtained. Disrupted gas flow causes interference with the weapon when the ammunition part, the shell or the projectile, is fired and thus affects the probability of the ammunition part hitting the target. The folding support eliminates the risks of the flaps formed when the pressure increases being thrown out and creates a support for the flaps in the opening stage so that there is a natural folding edge behind each flap defined by the break indications in the cover. The functioning of the support is very important for the magnitude of the recoil and for obtaining a repeatable operation for reduced performance spread of the weapon.

The folding support advantageously consists of an annular element shaped to fit tightly against the openable cover and the countermass container.

According to an expedient embodiment, where the openable cover is designed with a number of openable flaps, the folding support consists of an annular element including a thickening for each openable flap forming part of the cover.

There are many alternative materials for the folding support. A suitable group consists of polymeric materials.

According to another expedient embodiment, the cover is also provided with four radial break indications defining four openable flaps for interaction with the folding support. With a greater number of break indications and thus flaps, there is a risk that some of the flaps will not be separated from one another. This in turn results in an asymmetrical flow into the countermass container, which produces great shear forces on the barrel and great recoil variations within the temperature range.

According to an advantageous development of the arrangement, a pressure compensator is introduced between the countermass in the container and the cover. The pressure compensator creates an environment in the countermass container which is as uniformly pressurized as possible throughout the relevant temperature range, namely between −40° and +60°. Introduction of the pressure compensator creates similar conditions for the countermass irrespective of the temperature. This in turn results in as small a variation spread as possible in the opening operation of the cover, and the best opportunity for small recoil spreads has thus been created. The pressure compensator is advantageously made from a compressible material with closed cells, for example EPDM rubber.

BRIEF DESCRIPTION OF THE DRAWINGS

The invention will be described in greater detail below by means of a number of illustrative embodiments with reference to accompanying drawings in which.

DETAILED DESCRIPTION OF PREFERRED EMBODIMENTS

Figure 1:
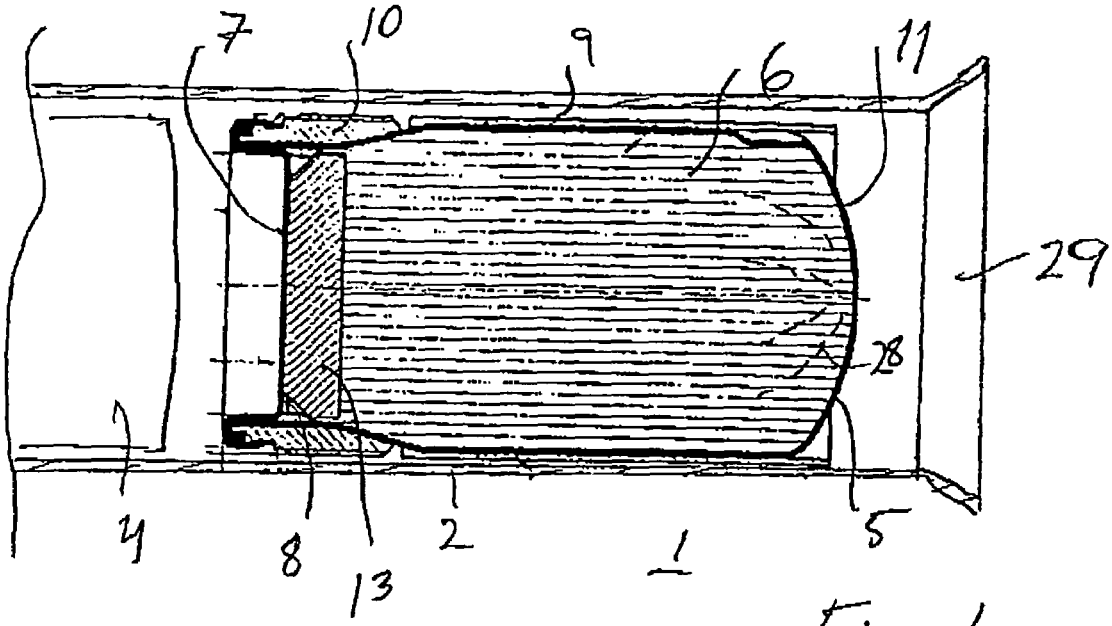
FIG. 1 shows in a longitudinal section the rear part of a weapon with an arrangement according to the invention.

The rear part of a weapon 1 shown in FIG. 1 comprises a barrel 2 accommodating an ammunition part 4 with a projectile, shell or the like, and a countermass container 5 with countermass 6. The countermass container is preferably made of titanium so as to be capable of standing up to a corrosive and aggressive countermass for a long time and at varying temperatures. One end of the countermass container 5 is sealed by means of a cover 7. The cover may also be referred to as a bottom plate or sheet. A folding support 8 is present on the inside of the cover. The container is surrounded by a casing 9 and is provided with a collar 10 for interaction with the cover 7. The countermass container also has a bottom section 11 provided with break indications 28 marked by dashed lines. Adjacent to the inside of the cover 7 is a pressure compensator 13, which can be attached to the cover by gluing.

Figure 2:
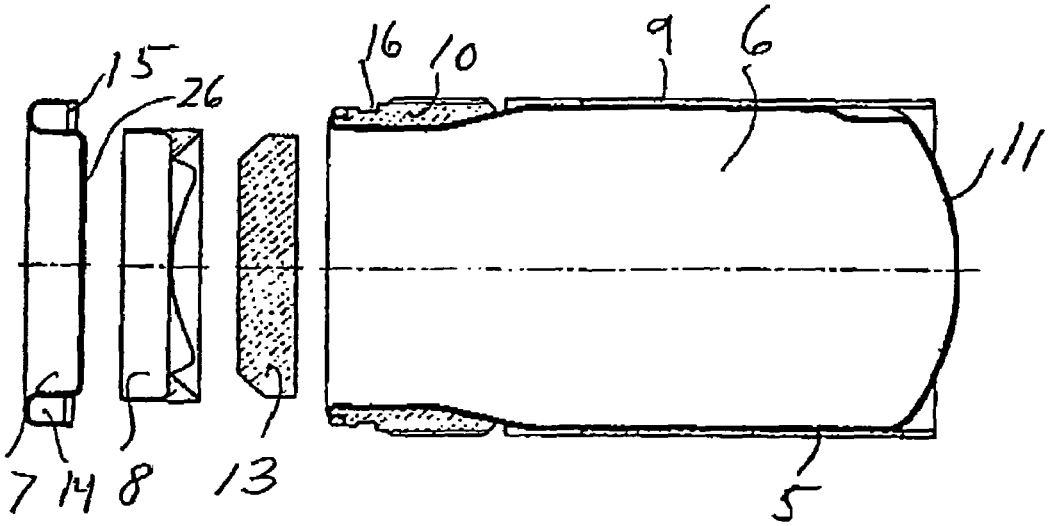
FIG. 2 shows in a longitudinal section a countermass container with associated sealing parts, forming part of the arrangement according to the invention, in a separated state.

FIG. 2 shows the countermass container 5 with the cover 7, the folding support 8 and the pressure compensator 13 separated from the container so as to illustrate each component included more clearly. Components with equivalents in FIG. 1 have been given the same reference numbers.

Figure 3:
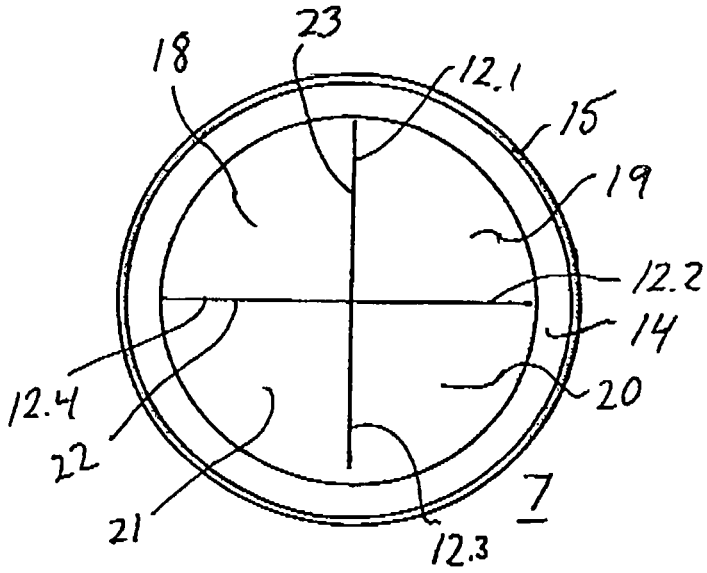
FIG. 3 shows the inside of a cover for sealing the countermass container.

The design of the cover 7 can be seen most clearly from FIG. 3 which shows the cover from the inside of the countermass container. The cover 7 is circular and comprises a peripheral groove 14 intended to grip around the opening of the countermass container. In the outer delimitation of the groove, there is a flange-like element 15 for engagement with a groove 16 in the collar 10 of the countermass container. Four radial break indications 12.1–12.4 are marked in the cover 7. The break indications 12.1–12.4 can be stamped and are sometimes referred to as grooves. The break indications form four flaps 18–21 in the cover 7, where two 22, 23 of the flap edges of each flap 18–21 can be separated from the flap edges of adjacent flaps, while a third edge 24 (see FIG. 4) can be subjected to pressure and bending forces without being separated physically from the periphery of the cover.

Figure 4:
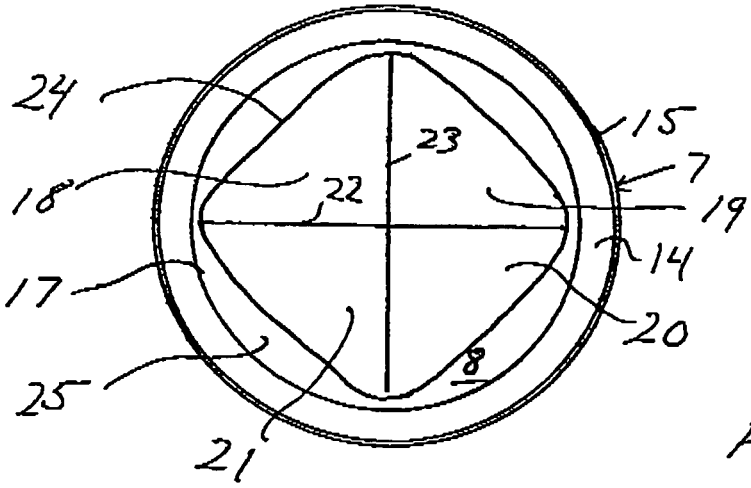
FIG. 4 shows a folding support mounted on the inside of the cover according to FIG. 3.

FIG. 4 shows the folding support 8 mounted in the cover 7. The folding support consists of a stronger peripheral ring 17 which can be fitted over a central projection 26 designed on the cover (see FIG. 2). Directly in front of the central part of the third flap edge, the peripheral ring 17 has a thickening 25 for each component flap. Material for the folding support can be selected from many material types, and some form of polymer, for example, can be used.

Figure 5:
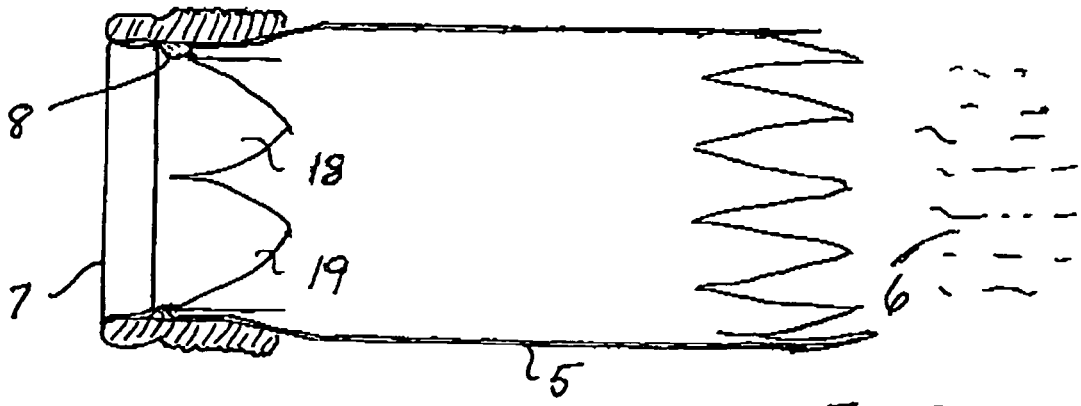
FIG. 5 shows diagrammatically in a longitudinal section the countermass container with associated sealing parts after activation of the countermass.

In the situation shown in FIG. 5, the countermass container 5 has been activated. The cover 7 has been broken open, and flaps 18–21 of the cover 7, of which the flaps 18, 19 are shown in the figure, lie bent around parts of the folding support 8. The bottom of the countermass container has been broken open guided by the break indications 28, and the countermass 6 has left the container.

The activation operation of the weapon is described in greater detail below with reference to the figures described above.

When the weapon is activated, a gas pressure is delivered to the cover 7 of the countermass container. At a predetermined pressure level, the cover opens at the break indications 12.1–12.4. The cover 7 is opened from the centre out towards the periphery, where the folding support 8 contains the movement and guides the flaps. Four flaps 18–21 are folded into the countermass over the peripheral ring 17 of the folding support 8 and primarily its thickenings 25. The functioning of the folding support is very important for the recoil. If the cover opens asymmetrically, this affects the flow into the countermass container 5, which results in the weapon moving transversely on the shoulder of the operator. Variation of the projected opening area also affects the magnitude of the recoil directly. The countermass container 5 is pressurized. The pressure is conveyed via the countermass 6 to the bottom section 11 of the countermass container, which, when a predetermined bursting pressure is reached, is opened guided by the break indications 28, and the countermass 6 is pushed out through the outlet 29 of the barrel 2.

When the countermass container is sealed, a small enclosed air volume is obtained in the container. The container is also slightly pressurized when the cover 7 is mounted. In the event of temperature variation in the countermass container, the enclosed air and the countermass will vary in volume, and the pressure also thus varies. This affects the opening resistance of the cover flaps 18–21.

In order to obtain a pressure variation which is as small as possible, a pressure compensator 13 has been introduced, mounted adjacent to the cover 7. The pressure compensator 13 regulates the pressure in the container by virtue of being compressed or expanded, which means that a uniform pressure environment is created in the countermass container 5. This reduces the variation spread in the functioning of the countermass container and affords an opportunity for a smaller variation spread in the functioning of the cover. A compressible material with closed cells, such as EPDM rubber, is proposed. Here, it is proposed that the pressure compensator is glued in the cover, but it can also be positioned freely in the volume in other constructions.

It is desirable for the countermass, in terms of its functioning, to move like a piston under the influence of the gas pressure without being an actual piston. However, inter alia the small quantity of air enclosed in the container in connection with the mounting of the cover 7 on the container 5 can disrupt the operation if it is not possible to control the air volume so that it is distributed in the countermass 6. Functioning is disrupted especially if the air collects at the upper edge of the container.

At the rear opening of the barrel, the built-in pressure in the countermass will cause the countermass to expand and disintegrate. This brings about rapid braking of the liquid cloud at the same time as liquid is a very good extinguisher of a following gas cloud. Rapid braking of the cloud is brought about at the same time as a considerable pressure-reducing effect is produced adjacent to the weapon.

The invention is not limited to the embodiments shown as examples above but can undergo modifications within the scope of the patent claims below.

The invention claimed is:

1. An arrangement for a weapon, comprising:

a barrel;

a countermass operative to reduce an increase in pressure around the weapon during firing of the weapon;

a container arranged in the barrel and enclosing the countermass;

an ammunition part arranged in the barrel in front of the container;

an openable cover arranged between the ammunition part and the countermass, the openable cover comprising break indications on the ammunition part side, the break openings defining a plurality of openable flaps; and a guiding folding support arranged adjacent to the openable cover between the openable cover and the countermass container, the folding support comprising an annular element comprising a thickening for each openable flap forming part of the cover, the thickness decreasing in thickness toward a center of the folding support.

2. The arrangement according to claim 1, wherein the ammunition part comprises a projectile.

3. The arrangement according to claim 1, wherein the ammunition part comprises a shell.

4. The arrangement according to claim 1, wherein the annular element of the folding element is shaped to fit tightly against the openable cover and the countermass container.

5. The arrangement according to claim 1, wherein the openable cover comprises four radial break indications defining four openable flaps for interaction with the folding support.

6. The arrangement according to claim 1, wherein the folding support comprises a polymeric material.

7. The arrangement according to claim 1, further comprising:

a pressure compensator arranged between the countermass and the cover.

8. The arrangement according to claim 7, wherein the pressure compensator comprises a compressible material with closed cells.

9. The arrangement according to claim 8, wherein the compressible material comprises Ethylene Propylene Diene Monomer rubber.

10. An arrangement for a weapon, comprising:

a barrel;

a countermass operative to reduce an increase in pressure around the weapon during firing of the weapon;

a container arranged in the barrel and enclosing the countermass;

an ammunition part arranged in the barrel in front of the container;

an openable cover arranged between the ammunition part and the countermass, the openable cover comprising break indications on the ammunition part side;

a guiding folding support arranged adjacent to the openable cover between the openable cover and the countermass container; and a pressure compensator arranged between the countermass and the openable cover.

11. The arrangement according to claim 10, wherein the pressure compensator is made from a compressible material with closed cells.

12. The arrangement according to claim 3, wherein the material comprises Ethylene Propylene Diene Monomer rubber.

13. An arrangement for a weapon comprising a barrel, comprising:

a countermass operative to reduce an increase in pressure around the weapon during firing of the weapon;

a container arranged in the barrel and enclosing the countermass, the container being adapted to be arranged behind an ammunition part to be arranged in the barrel;

an openable cover arranged between the ammunition part and the countermass, the cover being operative to seal the countermass container, the openable cover comprising break indications on an ammunition facing side; and a guiding folding support arranged adjacent to the openable cover between the openable cover and the countermass container.

* * * * *